United States Patent [19]

Katsumoto et al.

[11] Patent Number: 4,813,408

[45] Date of Patent: Mar. 21, 1989

[54] ENGINE COOLING DEVICE

[75] Inventors: Takehiko Katsumoto; Yoshiaki Danno; Daisuke Sanbayashi; Takashi Dogahara; Hidetsugu Kanao; Katsuo Akishino; Osamu Hirako, all of Kyoto; Hiroshi Kamada, Uji; Taizou Kitada; Masahiko Matsuda, both of Kyoto; Nobuaki Shimizu, Kameoka; Masaji Asada, Kyoto; Yoshinari Fukami, Kyoto; Takaaki Hirano, Kyoto, all of Japan

[73] Assignee: Mitsubishi Jidosha Kogyo Kabushiki Kaisha, Japan

[21] Appl. No.: 33,994

[22] Filed: Apr. 1, 1987

[30] Foreign Application Priority Data

| | | | |
|---|---|---|---|
| Apr. 1, 1986 | [JP] | Japan | 61-048327[U] |
| May 28, 1986 | [JP] | Japan | 61-079598[U] |
| Jun. 17, 1986 | [JP] | Japan | 61-091254[U] |
| Oct. 14, 1986 | [JP] | Japan | 61-156084[U] |

[51] Int. Cl.[4] ..... F01M 1/00

[52] U.S. Cl. ..... 123/196 AB; 184/104.1; 123/411.33

[58] Field of Search ..... 123/196 AB, 193 C, 41.33

[56] References Cited

U.S. PATENT DOCUMENTS

| | | | |
|---|---|---|---|
| 2,691,972 | 10/1954 | Stump et al. | 123/196 AB |
| 3,486,488 | 12/1969 | Frings | 123/41.33 |
| 4,397,269 | 8/1983 | Hatz | 123/196 AB |
| 4,446,827 | 5/1984 | Kubozuka | 123/193 C |
| 4,541,368 | 9/1985 | Castarede | 123/196 AB |
| 4,671,229 | 6/1987 | Barnes | 123/196 AB |

FOREIGN PATENT DOCUMENTS

| | | | |
|---|---|---|---|
| 2900556 | 7/1979 | Fed. Rep. of Germany | 123/41.33 |
| 2077352 | 12/1981 | United Kingdom | 123/41.33 |

*Primary Examiner*—E. Rollins Cross

*Attorney, Agent, or Firm*—Abelman Frayne Rezac & Schwab

[57] ABSTRACT

An engine cooling device comprises an oil jacket surrounding a cylinder portion of an engine, an oil gallery supplying high-pressure oil to various parts of the engine, and an oil pressure regulator disposed between the oil jacket and the oil gallery to reduce the pressure of the high-pressure oil supplied from the oil gallery and to supply the oil at a reduced pressure to the oil jacket. Thus, the required mechanical strength of the oil jacket can be decreased to decrease the weight of the engine cylinder block.

4 Claims, 8 Drawing Sheets

ENGINE COOLING DEVICE

BACKGROUND OF THE INVENTION

1. Field of the Invention

This invention relates to an engine cooling device, and more particularly to an engine cooling device of the kind including at least two engine cooling systems arranged around combustion chambers of an engine.

2. Description of the Prior Art

When the temperature of combustion chambers of an engine is excessively high, knocking occurs most frequently, and the intake air charging efficiency is lowered, giving rise to a reduced output. Further, since the operating valve system in the cylinder head generates frictional heat, it is generally desirable to cool an upper part of the combustion chambers at a relatively low temperature. On the other hand, it is generally desirable to cool a middle part and a lower part of the combustion chambers at a relatively high temperature. This is because, although frictional heat is generated at the sliding contact surfaces between the pistons and the inner walls of the combustion chambers, between the crank bearings and the crankshaft, etc. due to their state of fitting and oil film formation, it is considered rather expedient to maintain these parts at a relatively high temperature to reduce the frictional resistance thereby minimizing an undesirable reduction of the engine output.

An engine cooling device based on such an idea is known in which the cylinder head and the cylinder block of an engine are separately cooled by cooling water of a relatively low temperature and cooling water of a relatively high temperature respectively.

However, since cooling water started to boil and generate bubbles at about 100° C., there is a limit in the relatively high temperature of cooling water cooling the cylinder block of the engine.

A device which overcomes this limitation has been proposed. According to, for example, Japanese Patent Laying-Open No. 43118/1985, engine lubricating oil is led to the cylinder block of a water-cooled engine to cool the cylinder block by the oil.

In the disclosed device, pressurized lubricating oil delivered from an oil pump is fed into the jacket of the cylinder block. However, because the pressure of the lubricating oil is high than that of cooling water pumped out to cool the water-cooled engine, the jacket must have a high mechanical strength resulting in an increased weight of the engine.

SUMMARY OF THE INVENTION

It is an object of the present invention to provide an engine cooling device of the kind cooling the cylinder block of an engine by lubricating oil, in which the weight of the cylinder block can be rather decreased.

Another object of the present invention is to prevent intrustion of casting sand from an oil jacket into a main gallery for lubricating oil.

Still another object of the present invention is to facilitate venting of air from the oil jacket.

In accordance with the present invention which attains the above object, there is provided a device for cooling and engine including a water jacket formed in peripheral walls of combustion chambers for circulation of cooling water and an oil jacket formed in the walls of engine cylinders for circulation of cooling oil, the device comprising an oil gallery for supplying high-pressure oil to various parts of the engine, a high-pressure oil circulation system supplying the high-pressure oil to the oil gallery, and oil pressure regulating means reducing the pressure of the high-pressure oil to a predetermined value for supplying the oil at a reduced pressure to the oil jacket.

Thus, the pressure of the high-pressure oil supplied from the high-pressure oil circulation system to the oil gallery is regulated by the oil pressure regulating means, and the oil at the regulated pressure is supplied to the low-pressure oil jacket, so that these two oil circulation systems can be connected by the oil pressure regulating means.

Other and further objects of this invention will become obvious upon an understanding of the illustrative embodiments about to be described or will be indicated in the appended claims, and various advantages not referred to herein will occur to one skilled in the art upon employment of the invention in practice.

DESCRIPTION OF THE PREFERRED EMBODIMENTS

Figure 1:
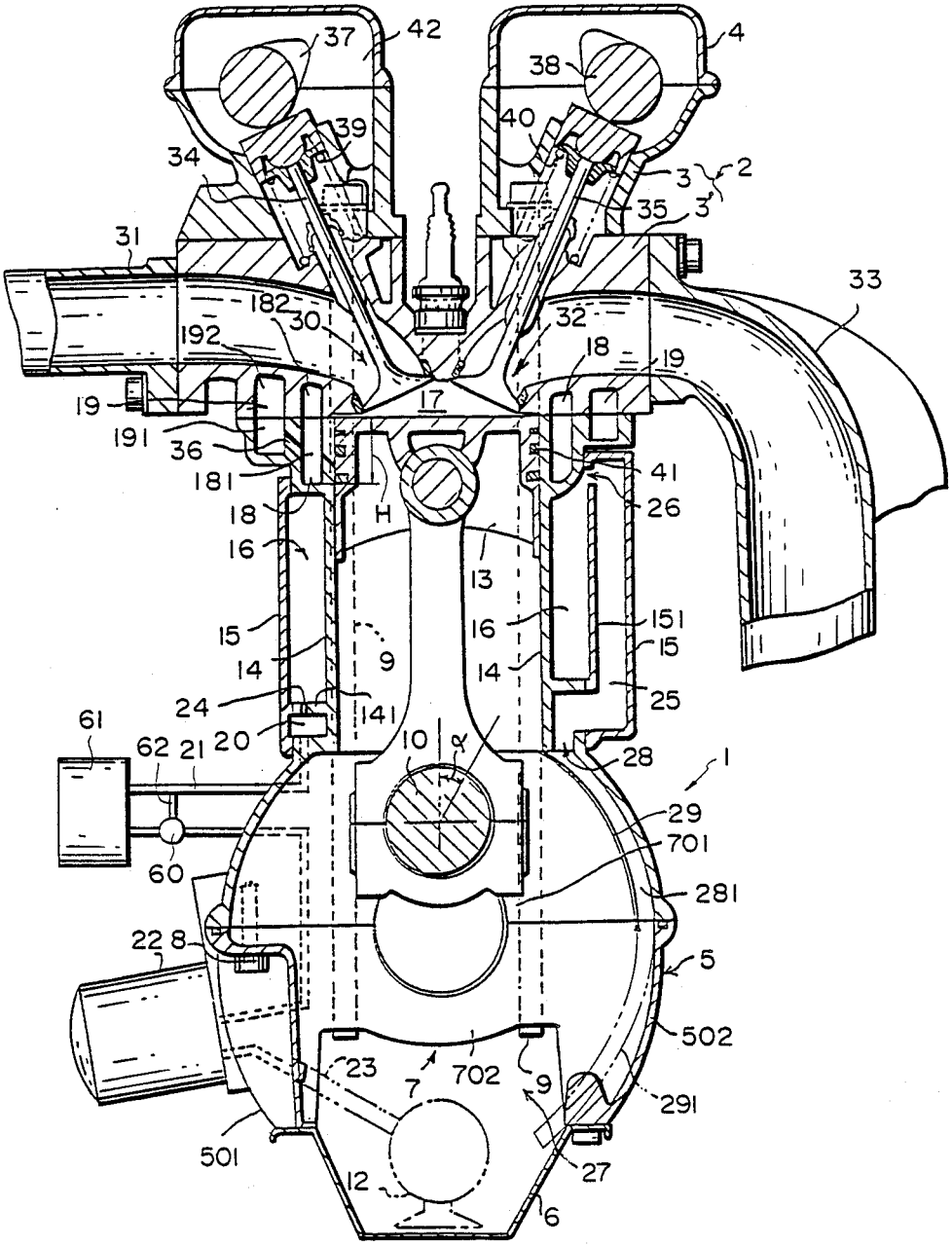
FIG. 1 is a sectional view showing the structure of an engine provided with a first embodiment of the present invention.
Figure 2:
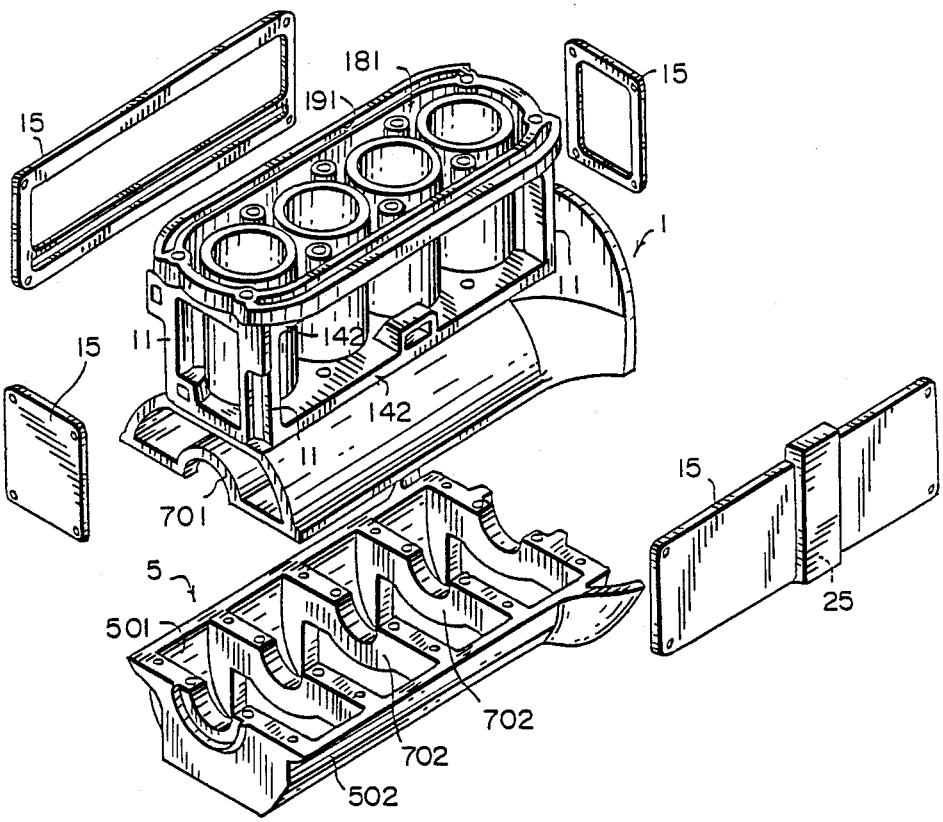
FIG. 2 is an exploded perspective view of the cylinder block shown in FIG. 1.
Figure 3:
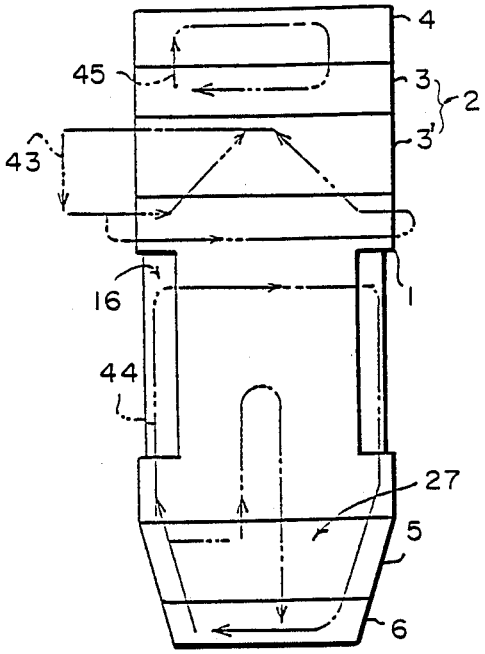
FIG. 3 is a diagrammatic view of cooling lubricating oil systems in the first embodiment.

FIGS. 1 to 3 show a first embodiment of the engine cooling device according to the present invention when mounted in a four-cycle engine of DOHC type.

The engine is constituted by a cylinder block 1, a cylinder head 2 disposed on the cylinder block 1, a cylinder head 2 is consist of head upper 3 and head lower 3', a cylinder head cover 4 disposed on the cylinder head upper 3, and a crank cover 5 and an oil pan 6 disposed below the cylinder block 1.

An elongate crankshaft 10 extending in the longitudinal direction (the direction vertical to the drawing sheet of FIG. 1) of the engine is disposed at the lower middle position of the cylinder block 1. A plurality of crank bearings 7 are provided for supporting the crankshaft 10, and upper members 701 of the crank bearings 7 are formed as an integral lower part of the cylinder block 1.

Lower members 702 of the crank bearings 7 are formed as an integral part of the crank cover 5. These lower members 702 are coupled from beneath to the upper members 701 formed on the cylinder block 1. That is, as best shown in FIG. 2, the crank cover 5 is a ladder-shaped member consisting of a left-hand skirt 501, a right-hand skirt 502, and the plural lower members 702 of the crank bearings 7 arranged between the skirts 501 and 502. The crank cover 5 is fastened at its marginal edges to the cylinder block 1 by a plurality of bolts 8, and the upper and lower members 701 and 702 of each of the crank bearings 7 are fastened together by two through bolts 9.

The downward opening of the crank cover 5 is closed by the oil pan 6, and an oil pump 12 for supplying lubricating oil to various portions of the engine from the oil pan 6 is disposed in the oil pan 6.

A cylinder portion 14 forms an inner peripheral wall member accommodating pistons 13 making vertical sliding movement. Closed oil jacket 16 is defined between the cylinder portion 14 and the covers 15. The covers 15 are formed at the peripheral side walls of the cylinder block 1. The cylinder block 1 is formed at its upper end with double annular grooves 181 and 191 surrounding combustion chambers 17. The inner annular groove 181 extends downward by a distance H from the upper end of the cylinder portion 14.

In the members forming the peripheral side walls of the cylinder block 1, the cylinder block 1 is cast without being covered by the covers 15 (open-sided). Thus, casting is facilitated as compared to casting of a prior art cylinder block in which the covers 15 are cast integrally with the cylinder portion 14. (That is, cores used for casting the oil jacket 16 is unnecessary.) As shown in FIG. 2, the cylinder block 1 is provided with four vertically extending columns 11, and the four covers 15 are bolted through packings (not shown) to the four columns 11 and upper and lower flanges 142 respectively.

Referring to FIG. 1, the cylinder portion 14 providing the peripheral side walls is formed at its left-hand lower end with an elongate strip 141 extending in the longitudinal direction of the engine, and the free end of the strip 141 makes intimate contact with the inner wall surface of the associated cover 15. This strip 141 defines part of the oil jacket 16 thereabove and an oil gallery 20 therebeneath.

A high-pressure oil passage 21 in a high-pressure oil circulation system supplies lubricating oil to the oil gallery 20, the oil gallery 20 circulates lubricating oil for lubrication and cooling of the bearing surfaces of the crank bearings 7 in a crank chamber 27, the sliding surfaces of the pistons 13, the oil jacket 16. The oil gallery 20 and the oil jacket 16 are generally formed as part of a lower oil circulating system 44 as shown in FIG. 3. That is, the oil pump 12 in this lower oil circulation system 44 delivers lubricating oil from the oil pan 6 into a high-pressure oil pipe 23. The delivered oil flows through an oil cleaner 22 mounted on an outer lower part of the cylinder block 1 and through a thermostat 60 and an oil cooler 61 into the high-pressure oil passage 21. Part of oil is supplied from this passage 21 to the relative sliding surfaces of the crank bearings 7 and pistons 13 by way of oil passages (not shown), and the other part is supplied to the oil gallery 20. A by-pass passage 62 is provided between the thermostat 60 and the oil passage 21, and, when the temperature of oil is lower than a predetermined value, the lubricating oil is returned by the action of the thermostat 60 to the oil passage 21 through the by-pass passage 62.

The high-pressure oil supplied to the oil gallery 20 flows into the associated part of the low-pressure oil jacket 16 through a plurality of orifices 24 formed at predetermined positions of the strip 141 to act as oil pressure regulating means. These orifices 24 are formed so that oil can uniformly flow into the oil jacket 16 which is elongate in the longitudinal direction of the engine.

Figure 4:
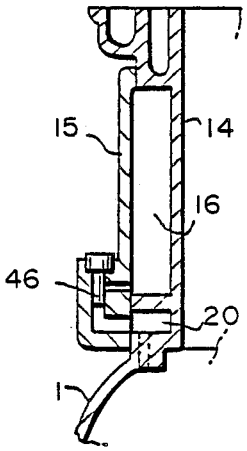
FIG. 4 is a sectional view of part of a second embodiment of the present invention.

Each of the orifices 24, by which the high-pressure oil gallery 20 is connected in series with the low-pressure oil jacket 16, may be replaced by an oil pressure regulator 46 (which may be a relief value or a check value) as shown in FIG. 4 illustrating part of a second embodiment of the present invention. In the arrangement shown in FIG. 4, the oil jacket 16 is completely separated from the underlying oil gallery 20 when the engine is stopped. Therefore, natural flow-down of oil can be prevented, so that the quantity of oil returning to the oil pan 6 during a long period of time of parking can be decreased, and the function of the oil jacket 16 as an oil reservoir can be fully achieved.

The left-hand and right-hand parts of the oil jacket 16 communicate with each other through passages between the walls of the cylinder portion 14 and through the front and back parts of the oil jacket (not shown). A vertically long return passage 25 is formed inside the right-hand cover 15 which cooperates with the cylinder portion 14 to form the right-hand part of the oil jacket 16. A longitudinal wall 151 defining this return passage 25 is an integral part of the cover 15 and has a generally U-like sectional shape. This return passage 25 provides means for communication between an overflow port 26 opening toward the upper end edge of the oil jacket 16 and an upper return port 28 of the crank chamber 27. A curved plate 29 disposed in the crank chamber 27 acts to permit smooth downward flow of oil from the return port 28.

The cylinder head 2 forming the upper peripheral walls of the combustion chambers 17 permits communication of intake ports 30 of the individual combustion chambers 17 with an intake manifold 31 and communication of exhaust ports 32 with an exhaust manifold 33 and contains intake and exhaust values 34 and 35. The cylinder head 2 is formed at its lower end with downward-opening annular grooves 182 and 192 which cooperate with the double upward-opening annular grooves 181 and 191 of the cylinder block 1 to form a water jacket 18 and an outer water gallery 19. The water jacket 18 extends upward to surround the intake ports 30 and exhaust ports 32.

The water gallery 19 and water jacket 18 are included in a cooling water circulation system 43 shown in FIG. 3. Cooling water supplied from a water pump (not shown) to the water gallery 19 is uniformly supplied from the water gallery 19 to the water jacket 18. That is, the water gallery 19 and the water jacket 18 communicate with each other at a plurality of positions through communication holes 36 having different inner diameters. An outlet port (not shown) is formed at a predetermined position of the water jacket 18, and cooling water from this outlet port is returned through a cooling water pipe (not shown) to the water pump (not shown). This cooling water is then supplied from the water pump to flow through a radiator (not shown) into an inlet port (not shown) of the water jacket 18.

The cylinder head upper 3 coupled to the cylinder head lower 3' from above is an upper part of the cylinder head 2 in a broad sense and contains an intake cam shaft 37, an exhaust cam shaft 38, intake valve springs 39, exhaust valve springs 40, etc. constituting the valve operating system. This cylinder head upper 3 is formed at its bottom wall with through holes for receiving the plural through bolts 9 by which the cylinder head upper 3, the cylinder head lower 3', the cylinder block 1 and the lower member 702 are unitarily combined together. The intake cam shaft 37 and the exhaust cam shaft 38 are driven from the crankshaft 10 by timing belts (not shown).

As described already, the lower end of the water jacket 18 is extended downward in the piston moving direction (the vertical direction), that is, by the distance H from the upper end of the cylinder block 1. This distance H is determined depending on the operating characteristics of the engine. In the present invention, this distance H is determined to correspond to a vertical position of the piston 13 opposite to a second ring 41 when the piston 13 moves downward by an angle $\alpha=\pm 30°$ from its top dead center. Thus, the present invention regards that knocking occurs most frequently in an area of about $\pm 30°$ in crank angle from the top dead center, and the distance H is determined so as to effectively absorb heat transmitted from the second ring 41 to the cylinder portion 14. This is because the heat transfer from the second ring 41 to the cylinder portion 14 has a direct influence on lowering the temperature of the combustion chambers 17 when the piston is in this operating range.

The through bolts 9 are exposed at their middle portions to the oil jacket 16, whereas the remaining portions are received in the bolt holes. Thus, the through bolts 9 used in this embodiment are disposed at positions where they extend at their middle portions through the oil jacket 16, so that these exposed portions are not deteriorated by rusting and need not be covered by cover members. Further, there is no need to employ an arrangement such as a prior art one in which the through bolts are disposed outside an outwardly curved water jacket structure (not shown).

The valve operating system in a cam shaft chamber 42 enclosed by the cylinder head upper 3 and cylinder head cover 4 is lubricated and cooled by an upper oil circulating system 45 (FIG. 3) provided separately from that associated with the crank chamber 27. That is, an oil pump (not shown) is mounted to the end of the intake cam shaft 37, and oil accumulating on the bottom wall of the cam shaft chamber 42 is supplied by the oil pump onto the relative sliding surfaces of the elements of the valve operating system.

In operation of the engine cooling device, the part of the cylinder head 2 surrounding the combustion chambers 17, and the range of the cylinder block 1 from its upper end to the lower end of the downward extension H are cooled by cooling water circulating through the water jacket 18. At the same time, the range between the principal part of the cylinder portion 14 surrounding the side part of the combustion chambers 17 (the range except the part between the upper end of the cylinder block 1 and the lower end of the downward extension H), and the crank chamber 27, are cooled and lubricated by cooling oil circulating through the lower oil circulation system 44 including the oil jacket 16 and oil pan 6. The valve operating system is cooled and lubricated by oil circulating through the upper oil circulation system 45.

Thus, when the engine shown in FIG. 1 operates, the two engine cooling and an engine lubricating systems 43, 44 and 45 operate independently of one another, so that the walls surrounding the upper part of the combustion chambers 17 are maintained at a relatively low temperature to suppress occurrence of knocking, and expansion of intake air is suppressed to improve the charging efficiency. Further, oil films are formed while maintaining the relative sliding surfaces of the crank bearings 7 and those between the cylinder portion 14 and the pistons 13 at a relatively high temperature, so that the frictional resistance of these parts can be greatly decreased to improve the engine output.

The left-hand part of the oil jacket 16 is connected to the oil gallery 20 through the orifices 24, which act as oil pressure regulating means, and the right-hand part thereof is connected to the crank chamber 27 through the return passage 25. Therefore, the pressure of oil in the oil jacket 16 is substantially equal to that in the crank chamber 27, that is, substantially equal to the atmospheric pressure. Since thus the mechanical strength of the covers 15 providing the oil jacket 16 need not be increased, the covers 15 of small thickness can be used to reduce the weight of the oil jacket 16.

Further, since the pressure of oil in the oil jacket 16 is low, the force imparted to the covers 15 is small enough to prevent leakage of oil (lubricating oil) from the joints between the covers 15 and the cylinder portion 14.

In addition, because of the low pressure of oil in the oil jacket 16, the force imparted to the cylinder block 1 is small so that, even in the presence of a casting defect, any cracking of the cylinder block 1 due to the pressure applied to the oil jacket 16 does not occur.

Further, because the internal pressure of the oil jacket 16 is substantially equal to the atmospheric pressure, air that may be included in the oil turns into bubbles in the oil jacket 16. Since thus the oil over flowing from the overflow port 26 of the oil jacket 16 into the return passage 25 is freed from bubbles, there are no bubbles mixing in the oil returned into the oil pan 6.

Also, since the internal pressure of the oil jacket 16 is substantially equal to the atmospheric pressure, the oil has not any substantial velocity and necessarily overflows from the overflow port 26.

In addition, the integral formation of the return passage 25 with the cover 15 simplifies the structure.

Further, since the oil jacket 16 is formed by mounting the covers 15 on the cylinder portion 14, casting cores for casting the cylinder portion 14 are unnecessary thereby reducing the cost of casting.

Referring to FIG. 1 again, a guide pipe 291 as shown by the alternate long and two short dashes line may be provided at the lower end of a passage 281 defined between the curved plate 29 and the cylinder block 1, and the lower end of this guide pipe 291 may be located in the oil pan 6. This arrangement is advantageous in that the oil returning through the return passage 25 can quickly return to the oil pan 6 without being obstructed by oil scattered by the crankshaft 10 in the crank chamber 27.

In the first embodiment, the overflow port 26 is formed at the middle only of the right-hand part of the oil jacket 16. However, this overflow port 26 may be extended in the longitudinal direction of the engine.

Figure 5:
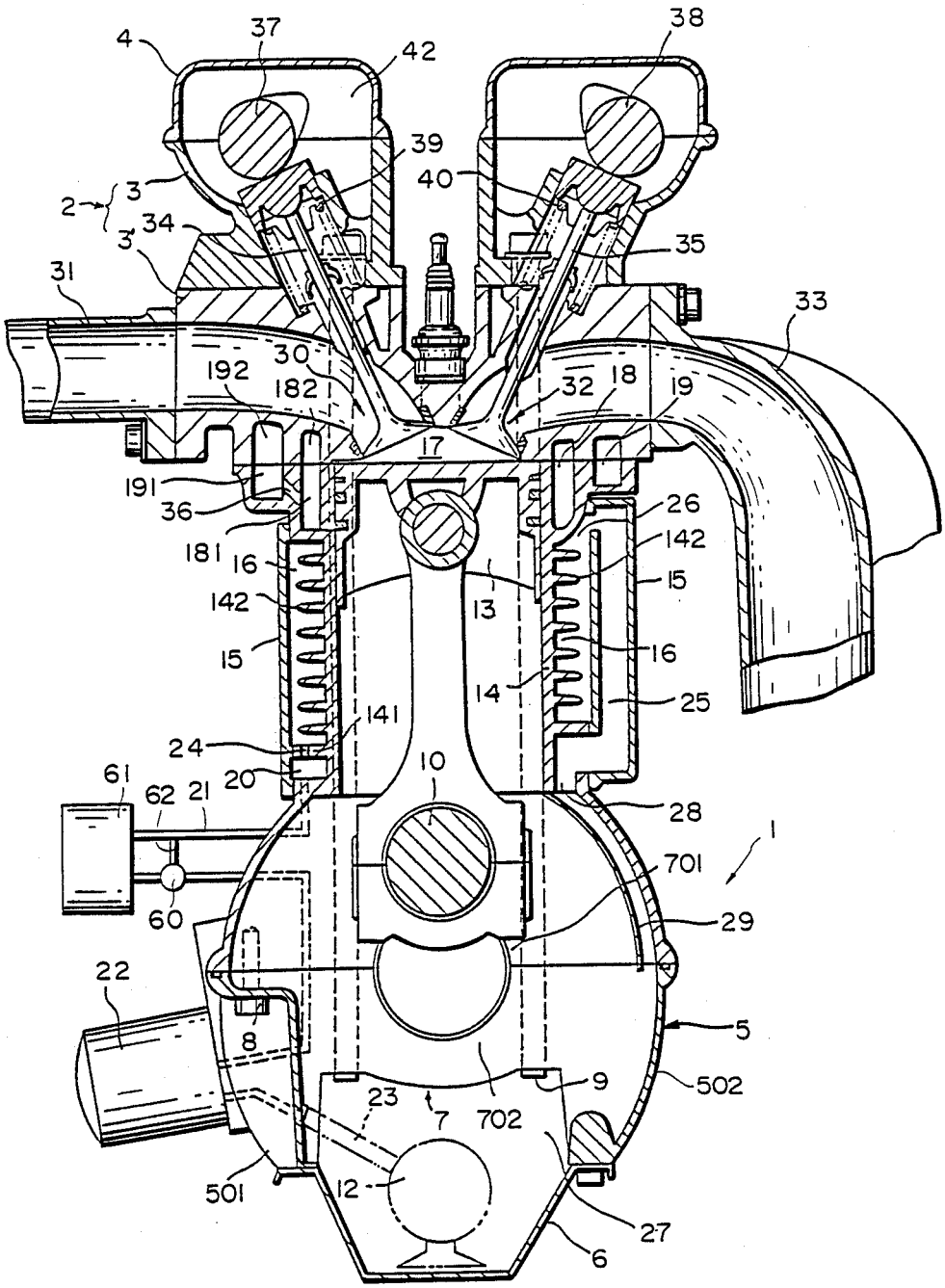
FIG. 5 is a sectional view of an engine provided with a third embodiment of the present invention.

In a third embodiment of the present invention shown in FIG. 5, a plurality of heat radiating projections or fins 142 are provided on the outer surface of the cylinder portion 14 of the first embodiment. This arrangement increases the contact area between the cylinder portion 14 and the lubricating oil so as to ensure sufficient heat exchange therebetween. The cylinder portion 14 of the cylinder block 1 can be cast without being covered by the covers 15 (open-sided). Thus, as described already, cores for providing the oil jacket 16 are unnecessary thereby simplifying the casting operation, and the cylinder portion 14 of complex shape having the fins 142 projecting therefrom can be easily cast. Therefore, the finely pitched fins 142 can be successfully formed.

Figure 6:
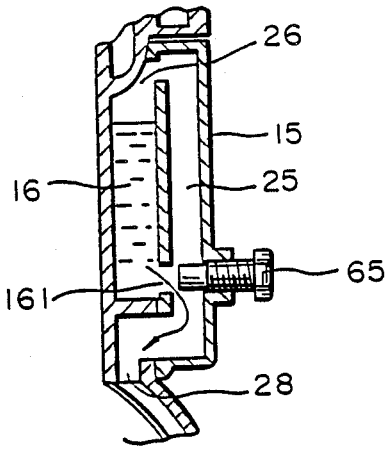
FIG. 6 is a sectional view of part of a fourth embodiment of the present invention.

FIG. 6 shows part of a sixth embodiment of the present invention. Referring to FIG. 6, a drain plug 65 is provided on the oil jacket 16 in the first embodiment. That is, an oil drain hole 161 is formed between the lower end of the oil jacket 16 and the return passage 25, and the drain plug 65 is screwed into the cover 15. The end of the drain plug 65 is removably inserted into the oil drain hole 161 to normally close the oil drain hole 161.

When it is desired to exchange lubricating oil in the cooling device, an oil drain hole (not shown) provided in the oil pan 6 (FIG. 1) is opened by the operator, and the drain plug 65 is then turned to open the oil drain hole 161. The lubricating oil in the oil jacket 16 is drained to the exterior through the oil drain hole 161, return passage 25 and oil pan 6. After complete drainage, the operator closes the oil drain holes in the oil pan 6 and oil jacket 16, and pours fresh lubricating oil from an oil changing hole (not shown). The operator starts the engine to drive the oil pump 12 (FIG. 1) so as to fill the fresh lubricating oil in the oil jacket 16. In this manner, the lubricating oil in the oil jacket 16 can be easily renewed.

Figure 7:
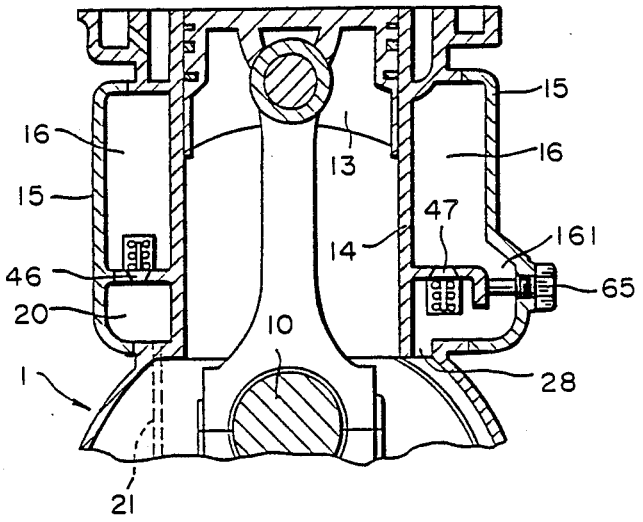
FIGS. 7 and 8 are sectional views of part of a fifth and a six embodiment respectively of the present invention.
Figure 8:
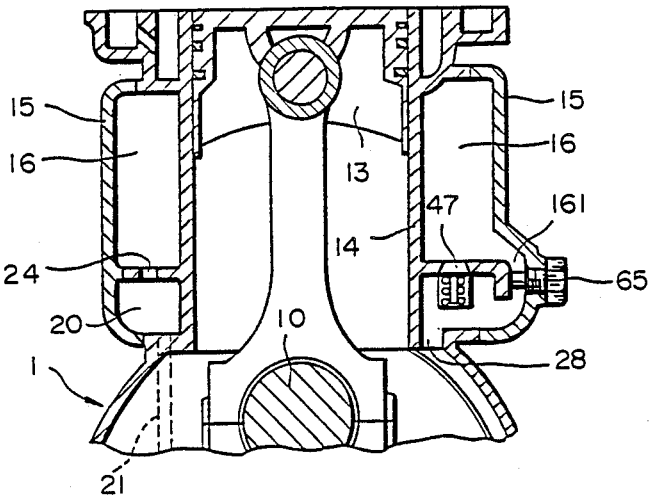

FIGS. 7 and 8 are sectional views of part of a fifth and a sixth embodiment of the present invention respectively. In the first embodiment, the overflow port 26 is provided in the oil jacket 16 so as to always reserve a predetermined quantity of oil in the oil jacket 16, while causing an overflow of oil from the oil jacket 16.

In the embodiments shown in FIGS. 7 and 8, a relief valve is used to reserve a predetermined quantity of oil in the oil jacket 16. More precisely, in the fifth embodiment shown in FIG. 7, an inlet relief valve 46 is provided at the communication hole between the oil gallery 20 and the oil jacket 16 to permit flow of oil into the oil jacket 16 from the oil gallery 20, in lieu of the orifices 24 provided in the first embodiment. On the other hand, an outlet relief valve 47 is provided at the communication hole between the oil jacket 16 and the return port 28 to permit flow out of oil through the return port 28 from the oil jacket 16. The inlet relief valve 46 acts to supply oil into the oil jacket 16, and the outlet relief valve 47 acts to discharge oil from the oil jacket 16. The relief pressure of the outlet relief valve 47 is selected to be lower than that of the inlet relief valve 46, so that a predetermined quantity of circulating oil can be always reserved in the oil jacket 16.

In the sixth embodiment shown in FIG. 8, an orifice 24 similar to that provided in the first embodiment is provided in place of the inlet relief valve 46 shown in FIG. 7, and the oil pressure regulated by the size of the orifice 24 and the relief pressure of the outlet relief valve 47 are suitably balanced, so as to reserve a predetermined quantity of oil in the oil jacket 16 while regulating the flow rate of oil in the oil jacket 16. In each of FIGS. 7 and 8, an oil drain hole 161 communicating with the oil pan 6 through the return port 28 is provided at the substantially lower end of the oil jacket 16, and a drain plug 65 is screwed into the cover 15 to close the oil drain hole 161. That is, although the oil drain hole 161 is normally closed by the drain plug 65, turning of the drain plug 65 in the direction of withdrawal from the oil drain hole 161 permits flow of oil from the oil jacket 16 toward and into the oil pan 6 through the oil drain hole 161.

Figure 9:
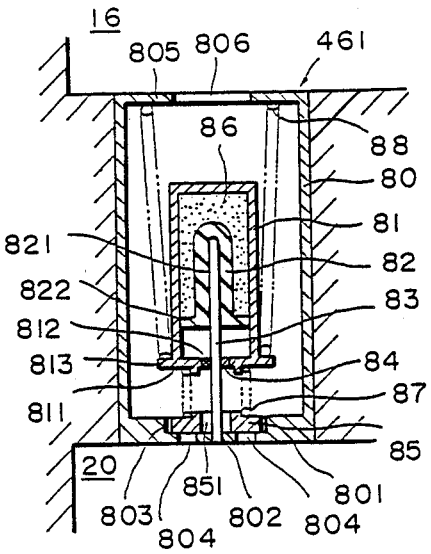
FIGS. 9 and 10 are sectional views of part of a seventh embodiment of the present invention.
Figure 10:
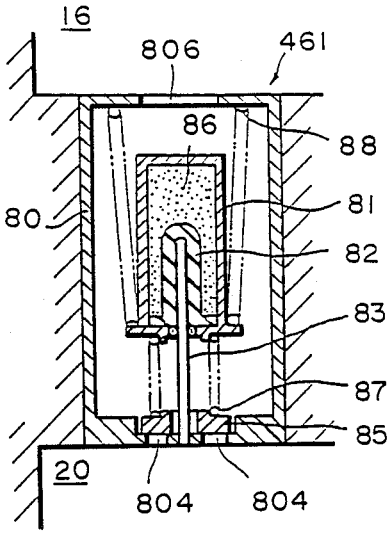

FIGS. 9 and 10 show part of a seventh embodiment of the present invention, and, in lieu of the orifices 24 provided in the first embodiment, a check valve 461, whose valve opening pressure in variable depending on the temperature, is interposed between the oil gallery 20 and the oil jacket 16. Referring to FIGS. 9 and 10, this hydraulic check valve 461 includes a cylindrical casing 80 having closed ends. A hole 802 is bored at the center of one end plate 801 of the cylindrical casing 80, and a recess 803 concentric with the hole 802 is formed in the end plate 801 in a relation stepped relative to the hole 802 so as to act as a valve seat. Further, a plurality of or, for example, two holds 804 acting as valve holes are formed around the hole 802 in the bottom wall of the recess 803, that is, in the end plate 801. A hole 806 having a larger diameter is bored at the center of the other end plate 805 of the casing 80.

A cylindrical thermostat casing 81 having closed ends is inserted in the valve casing 80. This thermostat casing 81 has a diameter smaller than that of the valve casing 80 and is axially movable in the valve casing 80. A hole 812 is bored in one end plate 811 of the thermostat casing 81 opposite to the end plate 801 of the valve casing 80, and a flange 813 is formed on the outer periphery of the end plate 811. A guide 82 is inserted in the thermostat casing 81. These casings 80 and 81 are made of a metal material.

The guide 82 is in the form of a cylinder having closed ends. One of the ends of the guide 82 is generally semi-spherical in shape, and an axial deep hole 821 is bored in the other end. A flange 822 is formed on the outer periphery of the other end of the guide 82 and slidably engages at its outer periphery with the inner peripheral surface of the thermostat casing 81. This guide 82 is made of, for example, rubber.

A rod 83 is received slidably and liquid-tight in the hole 812 of the thermostat casing 81 through a sealing member 84. This rod 83 is fixed at one end to the deep hole 821 of the guide 82 and at the other end to the hole 802 of the valve casing 80 while extending loosely through a hole 851 of an annular valve disc 85. This valve disc 85 is axially movably received in the recess 803 of the end plate 801 of the valve casing 80 with a slight gap defined therebetween. The valve disc 85 closes the valve holes 804 when it engages with the bottom surface of the recess 803. The rod 83 and the valve disc 85 are also made of a metal material.

A predetermined quantity of a temperature-sensitive material, for example, wax is filled in the space defined between the inner peripheral surface of the thermostat casing 81 and the guide 82. A spring 87 is disposed under compression between the end plate 811 of the thermostat casing 81 and the valve disc 85 in concentric relation. This spring 87 urges the valve disc 85 onto the bottom surface of the recess 803 thereby closing the valve holes 804. Another spring 88 is compressed between the flange 813 of the thermostat casing 81 and the corresponding end plate 805 of the valve casing 80. This spring 88 urges the thermostat casing 81 toward the end plate 801 of the valve casing 80. The valve opening pressure of the valve disc 85 is made variable by the combination of the wax 86 and the springs 87, 88.

The operation of the check valve 461 will now be described.

When the temperature of lubricating oil in the oil jacket 16 is lower than a predetermined temperature, the wax 86 charged in the thermostat casing 81 contracts, and its volume is small as shown in FIG. 9. The thermostat casing 81 is urged downward in FIG. 9 by the force of the spring 88, and the spring 87 is compressed to provide a large set pressure, so that the force imparted by the valve disc 85, hence, the valve opening pressure is high. As a result, the quantity of oil supplied to the oil jacket 16 decreases to suppress the cooling action by the oil. The temperature of oil in the oil jacket 16 rises immediately, and the temperature of the inner walls of the cylinders also rises, with the result that the viscosity of oil in the cylinders decreases to decrease the friction. Also, the warming-up of the engine in its starting stage is effectively attained.

With the rise in the temperature of oil in the oil jacket 16, the temperature of the wax 86 in the thermostat casing 81 also rises. The wax 86 expands, and its volume increases. Because the rod 83 is fixed at one end to the end plate 801 of the valve casing 80, the thermostat casing 81 is urged upward against the force of the spring 88 with the expansion of the wax 86, as shown in FIG. 10. At the same time, the spring 87 extends, and its set pressure decreases. As a result, the urging force of the valve disc 85 decreases to lower the valve opening pressure. Thus, even when, as described already, the rotation speed of the oil pump decreases, and, due to the increased temperature of oil and the lowered viscosity of oil, the delivery pressure of the oil pump decreases to decrease the pressure of oil supplied to the oil gallery 20, the hydraulic check valve 461 can be opened to ensure supply of oil from the oil gallery 20 to the oil jacket 16. Thus, stagnation of oil in the oil jacket 16 is prevented to restrict an unnecessary oil temperature rise thereby preventing a burn of the engine.

FIGS. 11 to 16 show hydraulic check valves preferably used in other embodiments of the present invention.

Figure 11:
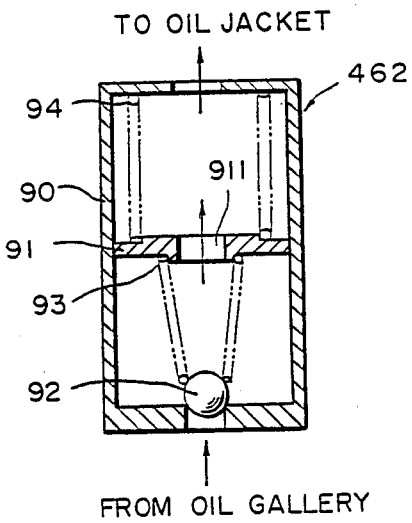
FIGS. 11 to 16 are sectional views of part of other embodiments of the present invention.
Figure 12:
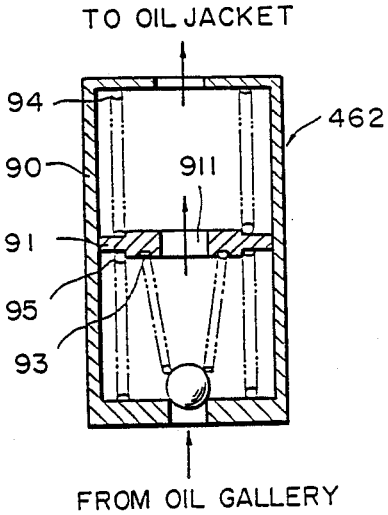

In a hydraulic check valve 462 shown in each of FIGS. 11 and 12, a spring made of a shape memorizing alloy is used as a temperature sensitive member in lieu of the wax 86 used in the check valve 461 shown in FIG. 9.

In FIG. 11, a supporting plate 91 having a central hole 911 is axially movably disposed in a cylindrical casing 90 having closed ends, and a conventional spring 93 is compressed between one of the surfaces of the supporting plate 91 and a check ball 92. Another spring 94 made of a shape memorizing alloy is interposed between the other surface of the supporting plate 91 and the corresponding end plate of the casing 90. The set pressure of the spring 94 is such that it is higher than that of the spring 93 when the temperature of oil is lower than a predetermined value, but becomes lower than the latter when the oil temperature exceeds the setting. That is, the valve opening pressure is so adjusted that it is high when the oil temperature is lower than the setting, but is low when the oil temperature exceeds the setting.

In FIG. 12, two springs made of a shape memorizing alloy are used to deal with both a high temperature and a low temperature. As in the case of the valve shown in FIG. 11, a conventional spring 93 and a spring 24 made of a shape memorizing alloy are disposed under compression on one and the other sides respectively of a supporting plate 91, and another spring 95 made of a shape memorizing alloy is also disposed on one side of the supporting plate 91. At a temperature lower than a predetermined value, the spring 94 extends to compress the springs 93 and 95, so that the set pressure of the spring 93 increases to provide a high valve opening pressure. On the other hand, when the temperature setting is reached, the spring 95 extends to compress the spring 94, so that the set pressure of the spring 93 decreases to lower the valve opening pressure.

Figure 13:
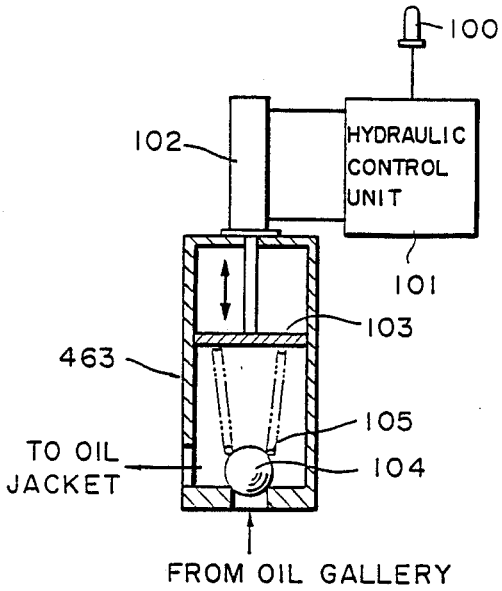

FIG. 13 shows a hydraulic check valve 463 whose valve opening pressure is adjustable by a hydraulic cylinder. Referring to FIG. 13, a temperature sensor 100 senses the temperature of a cooling liquid, for example, cooling oil in the oil jacket 16 and generates a corresponding temperature signal which is applied to a hydraulic control unit 101. When the level of the temperature signal from the temperature sensor 100 is lower than a predetermined level, the hydraulic control unit 101 decides that the temperature of oil in the oil jacket 16 is low, and a piston rod of a hydraulic cylinder 102 is advanced. As a result, the set pressure of a spring 105 interposed between a supporting plate 103 fixed to the free end of the piston rod and a check ball 104 of the check valve 463 is increased to increase the valve opening pressure of the check valve 463.

When the level of the temperature signal from the temperature sensor 100 exceeds the setting, the hydraulic control unit 101 decides that the temperature of oil in the oil jacket 16 has attained its setting, and the piston rod of the hydraulic cylinder 102 is retracted to decrease the set pressure of the spring 105 thereby decreasing the valve opening pressure of the check valve 463.

In lieu of detecting the temperature of oil as described above, the temperature sensor 100 may detect the temperature of cooling water in the cooling water circulation system 43 in the first embodiment.

Figure 14:
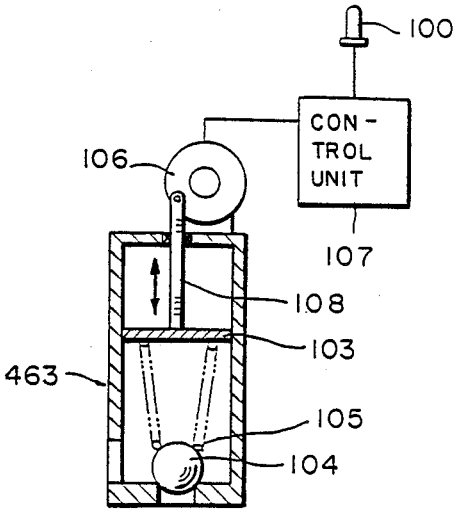

FIG. 14 shows a modification of the check valve 463 shown in FIG. 13. In this modification, the hydraulic cylinder 102 shown in FIG. 13 is replaced by an actuator of another form, for example, a stepping motor 106, and, in response to the temperature signal applied from the temperature sensor 100, a control unit 107 drives the stepping motor 106 for causing advancing or retracting movement of a rod 108, thereby adjusting the set pressure of the spring 105 interposed between the check ball 104 and the supporting plate 103 fixed to the free end of the rod 108, that is, adjusting the valve opening pressure of the check valve 463.

Figure 15:
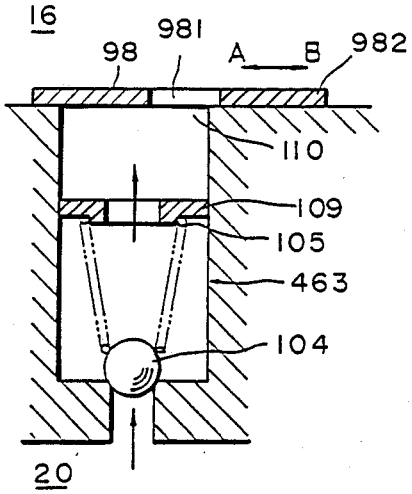
Figure 16:
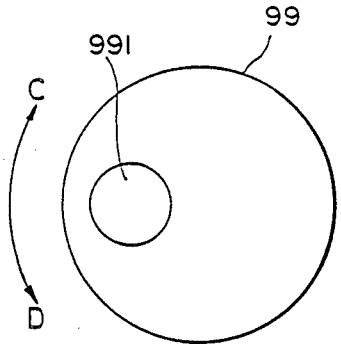

FIG. 15 shows another modification in which, in lieu of adjusting the valve opening pressure of the check valve 463, the area of an oil passage is changed to adjust the flow rate of oil. Referring to FIG. 15, the set pressure of the spring 105 interposed between the check ball 104 and the supporting plate 109 is maintained constant, and a slider 98 in the form of a square plate having a hole 981 is disposed to open and close a delivery port of the check value 463. In response to the temperature signal applied from the temperature sensor (not shown), the slider 98 connected at one end 982 thereof to a drive unit (not shown) is slided in a direction as shown by the arrow A or B, so as to suitably change the open area of the hole 981 of the slider 98. That is, the open area of the delivery opening 110 of the check valve 463 is changed to control the quantity of oil delivered from the check valve 463 thereby adjusting the flow rate of oil flowing into the oil jacket 16 from the oil gallery 20.

In lieu of the slider 98 shown in FIG. 15, a disc-shaped slider 99 having an eccentric hole 991 may be used. The slider 91 is rotated in a direction as shown by the arrow C or D to change the open area of the eccentric hole 991 so as to control the quantity of oil delivered from the check valve 643 thereby adjusting the flow rate of oil flowing into the oil jacket 16 from the oil gallery 20.

We claim:

1. An engine cooling device comprising an oil pan disposed beneath a cylinder block of an engine, an oil gallery communicating with said oil pan through an oil pump to supply oil under high pressure from said oil pan to various parts of said engine, an oil jacket provided on said cylinder block to cover outer peripheral walls of a cylinder portion accommodating a plurality of pistons making reciprocating movement, oil pressure regulating means disposed between said oil jacket and said oil gallery for reducing the pressure of said high-pressure oil and supplying oil at a reduced pressure to said oil jacket, a return passage permitting communicating between said oil jacket and said oil pan, and an overflow port formed at the upper end of part of said oil jacket to permit overflow of oil from said oil jacket, said overflow port communicating with said return passage.

2. An engine cooling device according to claim 1, wherein said oil pressure regulating means is an orifice provided in a wall partitioning said oil jacket from said oil gallery.

3. An engine cooling device according to claim 1, wherein said oil jacket is formed by covering the outer peripheral walls of said cylinder portion with covers prepared separately from said cylinder portion.

4. An engine cooling device according to claim 1, wherein a plurality of heat radiating projections are formed on the outer peripheral walls of said cylinder portion in said oil jacket.

* * * * *